US005722149A

United States Patent [19]

Lesage et al.

[11] Patent Number: 5,722,149

[45] Date of Patent: Mar. 3, 1998

[54] METHOD AND APPARATUS FOR THE FABRICATION OF METAL CYLINDERS

[75] Inventors: Claude Lesage, Rte Claire, Canada; Gerry O'Donnell, Canasioia, N.Y.

[73] Assignee: Giant Factories Inc., Montreal, Canada

[21] Appl. No.: 589,592

[22] Filed: Jan. 22, 1996

[51] Int. Cl.[6] ..... B23P 11/00

[52] U.S. Cl. ..... 29/505; 29/33 D; 72/51; 413/73; 413/75

[58] Field of Search ..... 29/505, 521, 243, 29/58, 33 D, 564.7; 72/51, 181; 219/64; 413/71–77

[56] References Cited

U.S. PATENT DOCUMENTS

| | | | |
|---|---|---|---|
| 510,796 | 12/1893 | Kegler | 72/51 |
| 2,730,983 | 1/1956 | Campbell, Jr. et al. | 413/77 |
| 3,154,037 | 10/1964 | Mayrath | 29/505 |

FOREIGN PATENT DOCUMENTS

| | | | |
|---|---|---|---|
| 310581 | 11/1916 | Germany | 413/77 |
| 8036830 | 10/1978 | Japan | 29/521 |

*Primary Examiner*—P. W. Echols

[57] ABSTRACT

A method and an apparatus for the fabrication of a metal cylinder from a flat metal sheet is described. The cylinder is preferably, but not exclusively, for use in the construction of an outer casing for a hot water heater. Particularly, the method and apparatus is suitable for the fabrication of cylinders of different diameters with minor adjustments being necessitated to the assembly apparatus. A flat metal sheet is fed through a roll former where a curved sheet defining an unconnected cylinder having opposed overlapping free side edges is formed. Flanges are formed along the elongated edges of the cylinder with the flange of the outer overlapping edge being inturned and the flange of the inner overlapping edge being outturned. These flanges form troughs with adjacent side wall portions of the unconnected cylinder and the flanges are guidingly displaced within the trough of the opposed flanges and are clamped in overlapping engagement and secured in this position to form an open-ended cylinder of predetermined diameter. These overlapped flanges can also be spot-welded together or otherwise immovably secured.

17 Claims, 3 Drawing Sheets

METHOD AND APPARATUS FOR THE FABRICATION OF METAL CYLINDERS

TECHNICAL FIELD

The present invention relates to a method and an apparatus for the fabrication of metal cylinders from a flat metal sheet of predetermined size whereby cylinders of predetermined diameters are automatically formed. Preferably, but not exclusively, the metal cylinder is for use as an outer jacket of a hot water heating tank and surrounds the inner casing in spaced relationship and about thermal insulation disposed around the inner casing.

BACKGROUND ART

Metal cylinders for use in outer casings of hot water tanks are usually formed manually. Elongated opposed end flanges are formed along opposed edges of a flat metal sheet which is then bent and the flanges are positioned within the troughs of the other flanges and held in this position manually. This cylinder is then introduced into a press to press the flanges in mating relationship. The mated flanges may then be welded. This is a labor intensive and slow process. Furthermore, because end caps are to be secured to the ends of the cylinders, the open-end edge portions of the cylinders are crimped by rotating the cylinder in a crimp press and this is done to opposed ends of the cylinder whereby to reduce their diameter to facilitate securing the caps. A base cap is secured to one of the cylinders. A cover cap is secured against the other open end once the inner casing, insulation and fittings have been installed. This slow labor intensive process of manufacturing the cylinder is very costly and manual errors can occur to cause defects in the outer casing. Semi-automatic jigs have been constructed to form these flanges and secure them together but these are restricted to cylinders of predetermined diameter. If the diameter and length of the cylinder is changed it is necessary to construct new jigs and this is even more expensive as new machines must be fabricated and they also occupy larger floor surfaces.

SUMMARY OF INVENTION

It is a feature of the present invention to provide a method and apparatus for fabricating a metal cylinder preferably, but not exclusively, for use as an outer casing of a hot water heater and wherein the method and apparatus is substantially automatic.

Another feature is to provide an apparatus capable of forming cylinders of different diameters and length with minor adjustments to the apparatus.

According to the above feature, from a broad aspect, the present invention provides an apparatus for fabricating a metal cylinder from a flat metal sheet. The apparatus comprises a loading station for feeding a flat metal sheet of predetermined size to a roll forming means to form a curved sheet defining an unconnected cylinder having opposed overlapping free side edges. Displacement means is provided to displace the unconnected cylinder. Flange forming means is provided to form an elongated inturned flange along an outer one of the overlapping free side edges and an outturned flange along an inner one of the overlapping free side edges. The flanges form troughs with an adjacent side wall portion of the unconnected cylinder. The displacement means also guidingly displaces the unconnected cylinder to a seam forming station where the flanges are displaced in meshing position by a flange positioning means whereby each of the flanges enter the trough of the other flange. Securement means is provided to connect the flanges in locking relationship to form an open-ended cylinder of predetermined diameter.

According to a still further broad aspect of the present invention there is provided a method for fabricating a metal cylinder from a flat metal sheet. The method comprises the steps of feeding a flat metal sheet of predetermined size to a roll forming means to form a curved sheet defining an unconnected cylinder having opposed overlapping free side edges. The unconnected cylinder is transferred to a means for displacing the unconnected cylinder into a flange forming means. An elongated inturned flange is formed along an outer one of the overlapping free side edges and an outturned flange is formed along an inner one of the overlapping free side edges. The flanges form troughs with an adjacent side wall portion of the unconnected cylinder. The unconnected cylinder is then guidingly displaced to a seam forming station where the flanges are displaced in meshing position by flange positioning means whereby each of the flanges enter the trough of the other flange. The flanges are then secured in locking relationship to form an open-ended cylinder of predetermined diameter.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
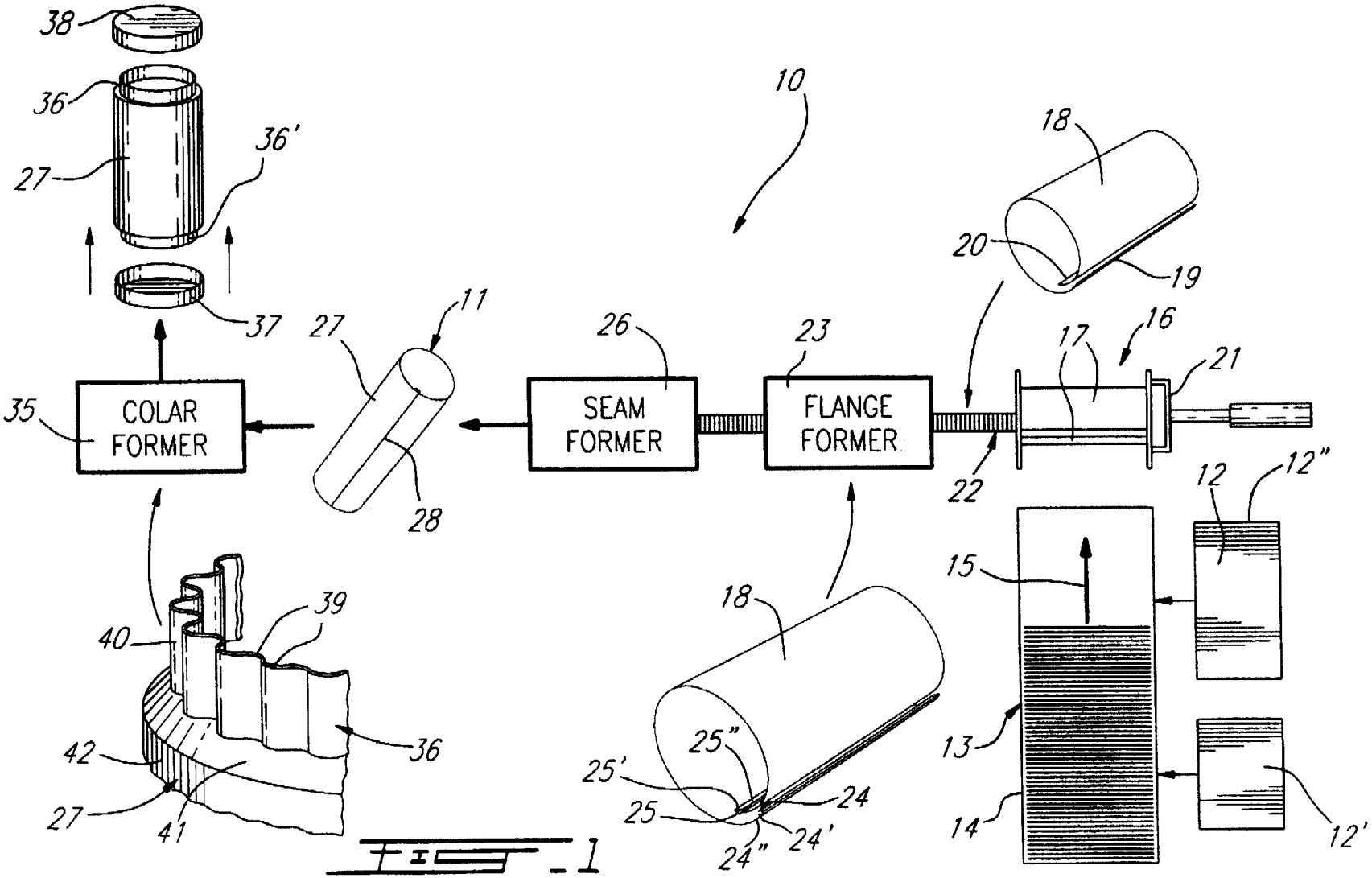
FIG. 1 is a block diagram illustrating the apparatus and method for the fabrication of a metal cylinder from a flat metal sheet and illustrating the various shapes that the sheet takes along the process of fabrication.

Referring now to the drawings and more particularly to FIG. 1 there is shown generally at 10 the method and apparatus for the fabrication of the metal cylinder 11 from a flat metal sheet 12. As hereinshown the apparatus has a loading station 13 to one side of which is held stacks of light gauge metal sheets 12 and 12' of different sizes depending on the length and diameter of the metal cylinder 11 to be fabricated. The metal cylinder herein shown is for use as an outer casing of a hot water tank.

At the loading station 13 a metal sheet 12 of predetermined size is transferred to the loading conveyor 14 and pushed in the direction of arrow 15 into a roll former 16 which consists of adjustable forming rolls 17 which are motor driven to draw the sheet 12 therein whereby to form a curved sheet hereinafter referred to as an unconnected cylinder 18 having opposed overlapping free side edges 19 and 20. This unconnected cylinder 18 is discharged from the roll former 16 by a piston operated displacement means 21 whereby to push the cylinder in an oriented fashion onto a further displacement means 22 where the cylinder 18 is engaged by clamping means, not shown, and moved into a flange former 23.

Figure 2A:
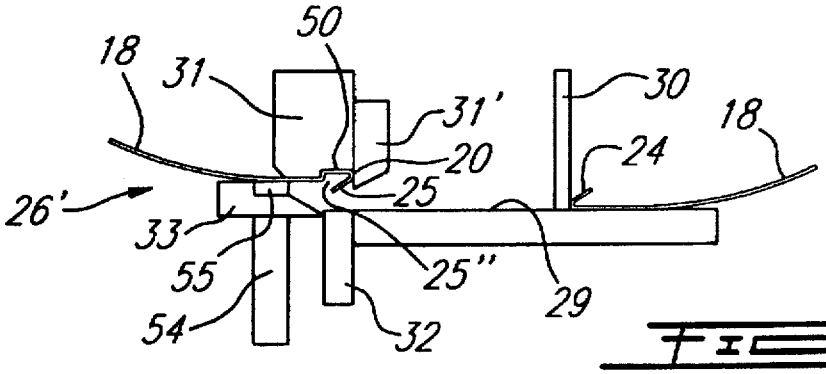
FIGS. 2A to 2F are simplified schematic section views showing how the flanges are positioned to enter each others troughs whereby to mesh in overlap relationship and pressed together to form a seal.
Figure 2B:
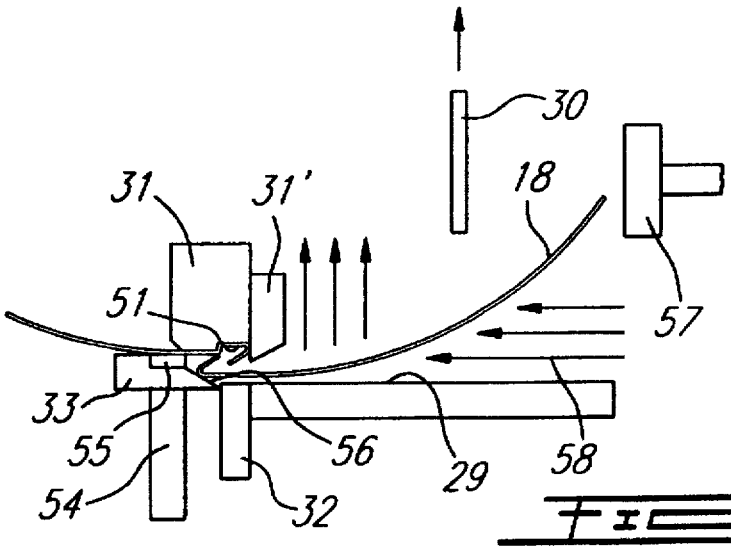

In the flange former 23 an elongated inturned flange 24 is formed along the outer one of the overlapping free side edges, namely, edge 19. An outturned flange 25 is formed along the inner side edge 20. As can be seen these flanges each form a trough 24' and 25' respectively with an adjacent inner side wall portion 24" and 25" of the unconnected cylinder 18. As shown in FIGS. 2A and 2B, the outward flange 25 is formed with a recessed inner wall section 50 which is dimensioned to form a confronting channel 51 to receive both flanges 24 and 25 therein when clamped and as more clearly seen from FIG. 2E. Accordingly, the outer surface of the formed cylinder is substantially flush throughout.

The displacement means 22 displaces the unconnected cylinder 18 with its formed flanges into a seam former 26 with the unconnected cylinder 18 positioned as shown in FIG. 2 and wherein the flanges are displaced in meshing position by flange positioning means 26' whereby each of the flanges 24 and 25 enter the troughs 24' and 25" of one another and are displaced in overlapping relationship and brought together to lock and form the open-ended cylinder 27 with a closed seam 28 as shown in FIG. 1.

The flange positioning means 26' is better illustrated schematically in FIGS. 2A to 2F. Firstly referring to FIG. 2F, the basic components of the flange positioning means are herein illustrated prior to receiving the cylinder free edges with their formed flanges. As hereinshown the flange positioning means consists of a support surface 29 above which is disposed a retractable gate 30 to receive thereagainst, as shown in FIG. 2A, the free end edge of the unconnected cylinder 18 with its inward flange 24 oriented as hereinshown. Spaced from the gate 30 is an elongated top stationary die 31 having a retracting edge guide bar 31' disposed thereagainst- The top die 31 is provided with a recess 31" in an area against an abutment edge portion 53 of the edge guide bar 31' whereby to receive therein the recessed inner wall 50 of the channel 51 adjacent the outturned flange 25 formed along the other free side edge of the unconnected cylinder 18.

Figure 2C:
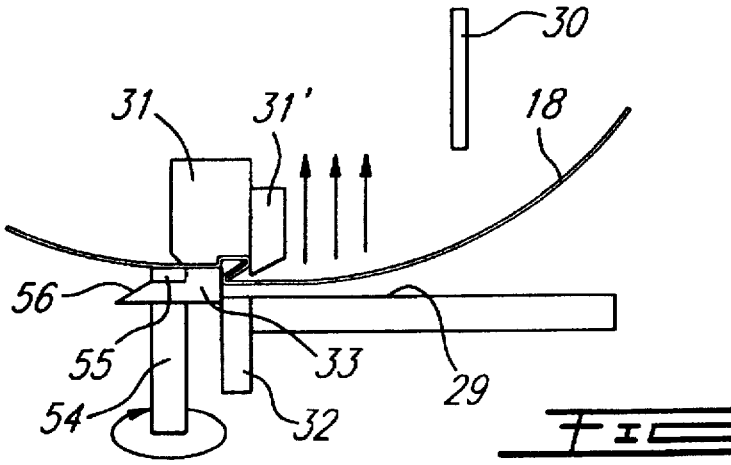

Aligned spaced apart and opposite the channel 31" of the top die 31 is a displaceable lower die bar which moves against the top die to press form the seam once the flanges 24 and 25 have been positioned in meshing engagement as will be described later. Simultaneously as the lower die 32 moves against the top die, the retracting edge guide bar 31' is also retracted. In order to guide the flanges in mating relationship there is provided a cam head 33 which is rotatable in an arc of 120° by means of a rotatable support shaft 54. The cam head 33 is provided with an upper cam edge 55 and a lower sloped guide edge 56 whereby to receive and guide the free edge having the inturned flange in position for mating engagement Referring now to FIG. 2A it can be seen that as the unconnected cylinder 18 is displaced from the flange former 23 into the seam former 26 the free edges 20 and 19 of the unconnected cylinders are held in abutment relationship against the abutment edge 25 of the guide bar 31' and the gate 30, respectively. The cam head 33 is at a receiving position and the lower die 32 is retracted, as hereinshown. Once the unconnected cylinder is in position within the seam former 26, the gate 30 is retracted, as shown in FIG. 2B, and simultaneously a pusher element 57 is displaced against the side wall of the cylinder 18 in the direction of arrows 58. This causes the free edge 19 with the inward flange 24 to strike against the guide edge 56 of the cam head 33 and ride up to assume an aligned position against the upper cam edge 55. As hereinshown, the inturned flange 24 faces the trough 25" of the outturned flange 25. The next step in the process is to rotate the support shaft 54 of the cam, as shown in FIG. 2C, whereby the shape of the upper cam edge 55 will move the inward flange 24 in meshing position into the trough 25" of the flange 25 with both flanges being superimposed.

Figure 2D:
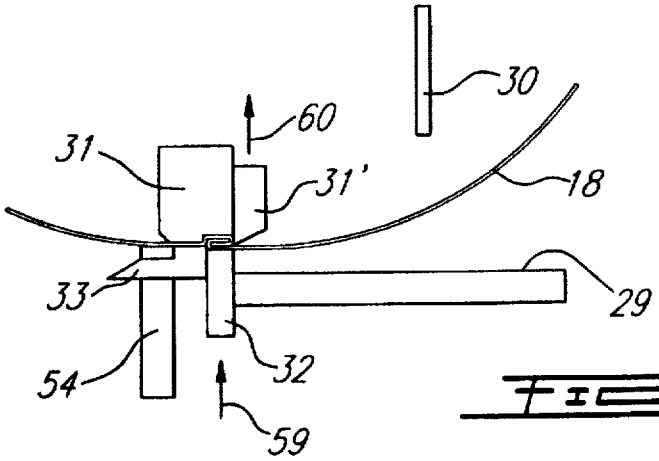
Figure 2E:
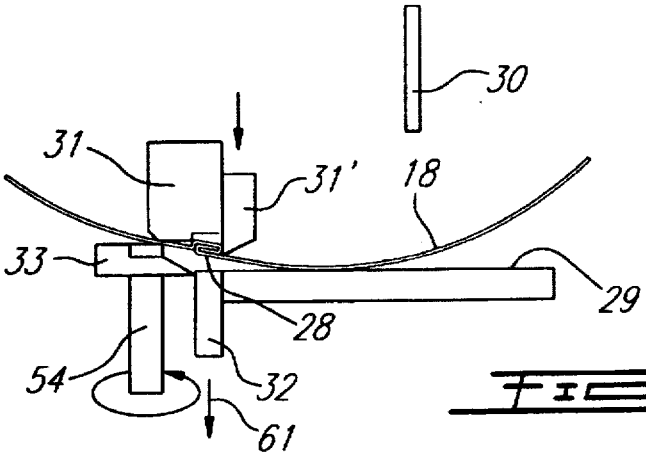
Figure 2F:
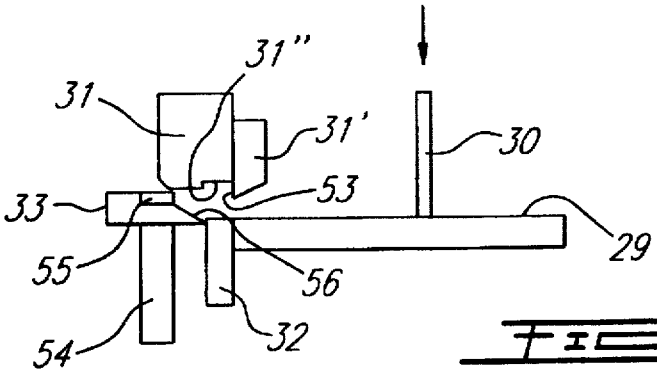

As shown in FIG. 2D, once the flange is superimposed the lower die 32 moves upward in the direction of arrow 59 and simultaneously the edge guide bar 31' is retracted upwardly in the direction of arrow 60. The superimposed flanges 24 and 25 are clamped together in firm engagement and located within the channel 51 formed in the edge wall section 50 adjacent the free edge 20. The lower die 32 is then retracted, in the direction of arrow 61 and the cam head 33 is rotated to its initial position whereby to free the cylinder 18 from the dies. The cylinder is then discharged from the seam former 26 by the displacement means 22 or other means (not shown).

Figure 3:
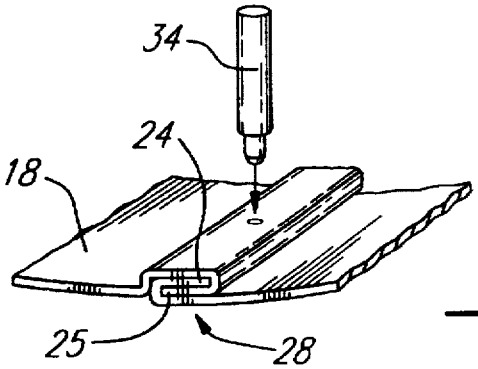
FIG. 3 is a fragmented perspective view showing the flanges connected together and spot welded.

At the seam forming station 26, or optionally at another further securement station welding heads 34, as shown in FIG. 3, are moved against the clamped flanges to immovably connect the overlapped flanges to form the closed seam 28. These welding heads 34 may be provided on both sides of the seam.

It is also pointed out, that in the flange former 23 the flanges are automatically formed by guide rolls (not shown) as the unconnected cylinder 18 is drawn therethrough by the engageable displacement means 22 which could be a worm or chain conveyor with clamps secured thereto.

After the open-ended cylinder 27 has been formed, the cylinder is then fed to a collar former 35 whereby to form a recessed circumferential collar 36 of reduced diameter as illustrated in FIG. 1. This circumferential collar is formed at at least one end of the cylinder and preferably both ends if a base 37 or cover 38 is to be secured to both open ends of the cylinder 27. As hereinshown the collar 36 is formed by a plurality of undulated formations 39 in an end portion 40 of the cylinder whereby this portion can be of reduced diameter. A narrow support ridge 41 results therefrom and is disposed intermediate the collar 36 and the side wall 42 of the cylinder 27.

We will now summarize the method of fabricating the metal cylinder 27 in a substantially automatic process. A flat metal sheet 12 is picked up by a suction cup transfer mechanism, not shown but obvious to a person skilled in the art, and placed onto the loading conveyor 14. Pusher means, also obvious to a person skilled in the art, displaces the sheet front edge 12" into the roll former 16 where the unconnected cylinder 18 is automatically formed. This cylinder is then transferred onto an engageable and displaceable mechanism 22 by a piston-actuated ejector device 21. The flange former forms the flanges 25 in a progressive manner and the unconnected cylinder is then fed to a seam former where, as shown in FIGS. 2A to 2F, the flanges are brought in overlapping facial relationship and are press-clamped together. At this station, or thereafter, the flanges may also be spot-welded together and an open-ended cylinder 27 with a closed seam 28 is discharged. Alternatively, the cylinder 27 may be automatically fed into a collar former 35 where opposed collars 36 and 36' of reduced diameter are formed at opposed ends of a cylinder whereby to receive, respectively, a base 37 and cover 38 to form a substantially sealed outer casing for an inner tank (not shown) of a hot water heater.

It is within the ambit of the present invention to cover any obvious modifications, provided such modifications fall within the scope of the appended claims.

We claim:

1. An apparatus for fabricating a metal cylinder from a flat metal sheet, said apparatus comprising a loading station for feeding a flat metal sheet of predetermined size to a roll forming means to form a curved sheet defining an unconnected cylinder having opposed overlapping free side edges, displacement means to displace said unconnected cylinder, flange forming means to form an elongated inturned flange along an outer one of said overlapping free side edges and an outturned flange along an inner one of said overlapping free side edges, said flanges forming troughs with an adjacent side wall portion of said unconnected cylinder, said displacement means guidingly displacing said unconnected cylinder to a seam forming station where said flanges are displaced in meshing position by flange positioning means whereby each said flange enters the trough of the other flange, and securement means to connect said flanges in locking relationship to form an open-ended cylinder of predetermined diameter.

2. An apparatus as claimed in claim 1 wherein said securement means comprises clamping means to clamp said overlapped flanges together.

3. An apparatus as claimed in claim 2 wherein there is further provided welding means to immovably connect said clamped overlapped flanges.

4. An apparatus as claimed in claim 1 wherein there is further provided piston-actuated ejector means for discharging said unconnected cylinder to said displacement means where said cylinder is engaged and oriented for progressive formation of said flanges by said flange forming means.

5. An apparatus as claimed in claim 1 wherein there is further provided the step of forming a recessed circumferential collar of reduced diameter at at least one end of said cylinder, and securing a cap about said collar to close one end of said open-ended cylinder.

6. An apparatus as claimed in claim 5 wherein a plurality of undulated formations are formed about said collar, and a narrow support ridge intermediate said collar and a sidewall of said open-ended cylinder.

7. An apparatus as claimed in claim 1 wherein said flange positioning means comprises abutment means for abuttingly guiding an outer end edge of said elongated inturned flange, pusher means to position said outturned flange in said trough of said inturned flange, and a clamp press constituting said securement means to clamp said flanges in meshing engagement.

8. An apparatus as claimed in claim 7 wherein said flange positioning means is comprised of a pair of spaced-apart cams, said abutment means being comprised by a cam head having an upper cam edge and a lower sloped guide edge, said inturned flange edge being displaced against said guide edge and slid to said upper cam edge, said cam edge when rotated causing said inturned flange to enter the trough of said outturned flange.

9. An apparatus as claimed in claim 8 wherein said outturned flange is formed with a recessed inner wall dimensioned to form a channel to receive said inturned flange therein, said flanges when clamped in meshing engagement being received in said channel whereby said seam is located inwardly of said cylinder and an outer surface of said cylinder in the area of said seam is substantially flush with the total outer surface thereof.

10. An apparatus as claimed in claim 8 wherein a gate is provided at said seam forming station to arrest said inturned flange edge spaced from said outturned flange edge, said outturned flange edge being held captive against an elongated top die of a press, and a displaceable press bar disposed in alignment and spaced under said top die.

11. A method for fabricating a metal cylinder from a flat metal sheet comprising the steps of:

i) feeding a flat metal sheet of predetermined size to a roll forming means to form a curved sheet defining an unconnected cylinder having opposed overlapping free side edges, ii) transferring said unconnected cylinder to a means for displacing said unconnected cylinder into a flange forming means, iii) forming an elongated inturned flange along an outer one of said overlapping free side edges and an outturned flange along an inner one of said overlapping free side edges, said flanges forming troughs with an adjacent side wall portion of said unconnected cylinder, iv) guidingly displacing said unconnected cylinder to a seam forming station where said flanges are displaced in meshing position by flange positioning means whereby each said flange enters the trough of the other flange, and v) securing said flanges in locking relationship to form an open-ended cylinder of predetermined diameter.

12. A method as defined by claim 11 wherein said step (v) comprises pressing said flanges together in clamping engagement to immovably interconnect same.

13. A method as defined by claim 12 wherein said step of immovably interconnecting said flanges comprises spot welding said flanges which are clamped together.

14. A method as defined by claim 12 wherein said step (v) further comprises simultaneously retracting an edge guide bar of a top die of a press as a lower die of said press moves against said flanges to press them between the top and lower dies.

15. A method as defined by claim 11 wherein there is further provided the step after step (v) of forming a recessed circumferential collar of reduced diameter at at least one end of said cylinder.

16. A method as defined by claim 15 wherein there is further provided the step of securing a base about said collar to close one end of said cylinder.

17. A method as defined by claim 11 wherein said step (iv) comprises a) positioning said free side edge having said inward flange against a gate, b) positioning said free side edge having said outward flange against a top die of a press, c) releasing said gate to displace said free side edge having said inward flange to abut against a cam head, and d) rotating said cam head to cause said inward flange to enter said trough of said outward flange.

* * * * *